United States Patent [19]

Mason

[11] Patent Number: 4,465,117

[45] Date of Patent: Aug. 14, 1984

[54] INGOT MOLD SHIELDS

[75] Inventor: Charles G. Mason, Gadsden, Ala.

[73] Assignee: Republic Steel Corporation, N.J.

[21] Appl. No.: 284,712

[22] Filed: Jul. 20, 1981

[51] Int. Cl.[3] ..... B22D 33/04; B22D 7/06; B22D 7/12; B29C 1/02

[52] U.S. Cl. ..... 164/137; 249/116; 249/135; 249/174; 249/206

[58] Field of Search ..... 164/57.1, 133, 137, 164/412; 249/112, 116, 135, 174, 206

[56] References Cited

U.S. PATENT DOCUMENTS

| | | | |
|---|---|---|---|
| 686,952 | 11/1901 | Price et al. | 249/114 R |
| 1,027,585 | 5/1912 | Bennett | 249/114 R |
| 1,209,283 | 12/1916 | Gathmann | 249/74 |
| 1,457,763 | 6/1923 | Adams | 164/6 |
| 1,570,473 | 1/1926 | Gathmann | 249/136 |
| 1,600,674 | 9/1926 | Kass | 249/33 |
| 1,678,976 | 7/1928 | Durfee | 164/57.1 |
| 1,743,932 | 1/1930 | Reed | 249/111 |
| 1,893,206 | 1/1933 | Messler et al. | 249/62 |
| 1,909,975 | 5/1933 | Mackey et al. | 164/412 |
| 2,054,597 | 9/1936 | Gathmann | 249/111 |
| 2,070,532 | 2/1937 | Gathmann | 249/111 |
| 2,211,361 | 8/1940 | Asimou et al. | 249/62 |
| 2,273,543 | 2/1942 | Terrill | 249/206 |
| 2,453,643 | 11/1948 | Schmertz | 249/206 |
| 2,743,493 | 5/1956 | Schmertz et al. | 249/206 |
| 2,763,043 | 9/1956 | Grant | 249/62 |
| 2,907,083 | 10/1959 | Shakely | 249/174 |
| 2,913,785 | 11/1959 | Kramig, Jr. | 249/62 |
| 3,163,898 | 1/1965 | Demaison | 249/174 |
| 3,360,849 | 1/1968 | Buschmann | 29/402.16 |
| 3,436,883 | 4/1969 | Charman, Jr. et al. | 164/137 X |
| 3,514,069 | 5/1970 | Daley | 249/111 |
| 3,607,197 | 9/1971 | Ballantine et al. | 65/169 |
| 3,837,393 | 9/1974 | McQuillen, Jr. | 164/342 |
| 3,942,580 | 3/1976 | Hazlehurst | 164/55.1 |
| 3,945,426 | 3/1976 | Walker et al. | 164/137 |
| 4,333,630 | 6/1982 | Strange | 249/135 |

FOREIGN PATENT DOCUMENTS

| | | | |
|---|---|---|---|
| 547876 | 10/1956 | Belgium . | |
| 1962801 | 6/1971 | Fed. Rep. of Germany | 164/137 |
| 2012908 | 10/1971 | Fed. Rep. of Germany | 164/137 |
| 2423410 | 11/1975 | Fed. Rep. of Germany | 164/137 |
| 1266553 | 6/1961 | France . | |
| 993207 | 5/1965 | United Kingdom . | |

*Primary Examiner*—Gus T. Hampilos
*Assistant Examiner*—Jerold L. Johnson
*Attorney, Agent, or Firm*—Watts, Hoffmann, Fisher & Heinke Co.

[57] ABSTRACT

An ingot mold with mold wall and stool shields and the method of installing the mold wall and stool shields to the ingot mold and stoll. The mold wall shield comprises at least two portions connected by a bend. The mold wall shield and the stool shield can be multi-layered to provide a thin envelope or layer of air between the parallel layers. The shields are nailed to the mold or stool by an explosion actuated hammer. The mold wall shield is installed with the bend near the intersection between the mold and the stool. The shields are made of similar material to that being cast and melt due to the heat of the molten metal in the mold.

11 Claims, 8 Drawing Figures

INGOT MOLD SHIELDS

TECHNICAL FIELD

This invention relates to casting of steel ingot and more particularly to ingot mold shields and methods for installing same.

BACKGROUND ART

Open bottom ingot molds are supported on block slabs called stools, and are usually made of cast iron. These molds, which are from six to ten feet high have an open top through which molten steel is poured. They are conventionally of a rectangular shape and of decreasing cross-section from the bottom to the top of facilitate removal of the mold from the cooled metal ingots.

Due to variances during the manufacture of the molds and the stools, the bottom rim of the mold forming the joint between the rim and the stool is irregular. As the mold is used, these irregular areas erode under contact with the molten metal. As the joint between the mold stool and the mold rim loses integrity, the molten metal escapes the container and cools under the mold rim causing "ribs" or "fins" on the cooled ingot. Removal of the ribs or fins is necessary before further working of the ingot may be accomplished.

At the initiation of the pour, a crucible of hot molten steel is poured through the open top portion of the mold. The stream of molten steel dropping some six to ten feet inside the mold, hits the mold stool with considerable force splashing molten steel onto the sidewalls of the mold and causing a concave erosion of the stool surface. This erosion of the stool surface results in a convex bottom or "knob" on the ingot. This knob makes handling of the ingot difficult and prevents the ingot from standing totally upright in a soaking pit furnace and in other processing of the steel. As a result, the ingot may contact another ingot in the soaking pit or contact the pit wall causing damage to the furnace. In addition, the erosion of the stool frequently causes the ingot to become welded to the stool causing what is known as a "stool sticker".

The splashing of the molten steel on the sidewalls at the beginning of the pour continues until a sufficient amount of molten steel accumulates in the bottom of the mold to provide a cushion for the on-flowing stream. Because the walls of the mold are cold, the splashing steel often solidifies and oxidizes before the metal level in the mold reaches the splashed material. These oxidized particles form "scabs" which, like ribs, fins, or knobs, must be removed from the ingot prior to further processing.

In order to alleviate one or more of the foregoing problems, many splash shields, splash cans, joint sealers, mold shields, and the like have been proposed. One conventional method for providing a seal between the mold rim and the stool is to caulk the joint or erroded channels with a refractory material which is placed around the outside of the mold. This practice allows the formation of ribs or fins on the inside of the mold in spaces that are not completely caulked with the refractory material. In another method, refractory material or fiber is used to caulk the joint between the mold rim and the stool surface from the inside of the mold. The material can be combustible so that it is burned out by the molten metal. These caulking methods are labor intensive since the joint must be caulked entirely from inside the mold.

Another means of mold protection involves a so-called "splash can" or splash shield which is placed substantially flat along the wall of the mold to prevent scab formation on the ingot due to splashing as the mold is filled with molten material. In another method, a splash can or mold liner is a self-supporting, rigid structure which is inserted into the mold. The liner is consumable, and becomes an integral part of the formed ingot. An attendant drawback is that insertion of the liners in molds which have the "big end down" must be accomplished from the bottom opening of the mold.

Steel sheet material has also been used as mold guards. The metal sheet is placed interior the mold resting against one or more of the interior mold surfaces. The unattached sheets tend to migrate, shift or float from the turbulent action of the molten steel allowing the molten steel to "creep" between the shield and the mold.

It has been suggested that such shields or mold guards be fastened to the mold surface by means of bolts. This concept however, requires that threaded bores be provided in the interior wall. In installing such shields, the holes must be aligned and the bolts inserted. This procedure is labor intensive.

DISCLOSURE OF THE INVENTION

The present invention provides mold shields including joint sealers, splash shields, and stool guards which are consumable in molten steel but do not dislodge in the turbulence created by pouring such that the mold is protected from deterioration and erosion; and, scabs and splash spots are prevented from occurring on the ingot. It has been discovered that mold shields which prevent scabbing, ribs, stool leakers and stool erosion can be effectively and efficiently secured to the interior surface of an ingot mold, so as not to dislodge during pouring, by nailing the shield to the mold using a powder actuated tool. In this manner the shield is securely fastened and is consumed by the molten metal after the pouring process. The consumed shield material is, by agitation of the molten metal mass, intermixed into the ingot to provide a substantially homogeneous ingot which is easily removed from the mold and does not contain ribs, scabs, knobs or the like. In addition the mold life is substantially prolonged.

In the broad aspect, a system for prolonging the useful life of a steel ingot mold includes a mold shield of a metal sheet material compatible with the molten metal, which is positioned within the mold cavity such that the poured and splashed molten metal impinges upon the surface of the shield rather than on the walls or floor of the mold cavity and which is fastened to the surface of the mold wall by means of nails driven through the mold shield and imbedded into the mold wall by an explosive nailing process. In this manner, molds can be easily and readily prepared for pouring on the cast house floor by positioning and nailing the shields in place just prior to pouring the metal. The mold is thus prepared by attaching the thin section of sheet metal to the interior of the mold by means of an explosive nailing process wherein a powder actuated tool is used to propel fastening nails through the sheet into imbedded relationship with the interior mold wall and/or stool surface. When the metal is poured the mold shield and the nail heads are infused into the formed billet which is removed from the mold in a conventional manner.

In one aspect, a shield or guard is constructed of more than one layer of sheet metal material compatible with the metal to be poured. The multilayered shield is nailed to the mold stool or walls to provide a thin envelope or layer of air between parallel sheets of material. In this manner, a shield with entrapped layers of air is provided such that the molten metal impinging on the upper most layer is deflected for a time sufficient to allow a cushion of molten material to form. The upper layer maintains integrity for a time sufficient to allow sufficient material buildup. As the top layer looses integrity each shielding layer forms a fresh protective surface to prevent contact of the molten steel with the stool surface.

In another aspect a wall shield which substantially covers one interior vertical wall surface of the mold is bent to provide an angled, flanged portion on one end thereof which is adapted for sealing the joint between the mold rim and the stool.

In accordance with another aspect, there is provided a method for securing a mold shield to the interior surface of a mold by first positioning the shield material to be fastened against the mold surface to be protected and propelling nails through the mold shield into imbedded relationship with the mold walls by means of an explosive nailing process. When wall shields having two portions connected by a bend are utilized to seal the joint between the mold rim and the mold stool, one portion is first positioned flush against the stool and secured by means of the explosive nailing process. The upstanding wall shield portion is then secured to the interior of the mold wall in a similar manner. The stool guard, which preferably contains more than one layer of sheet material, is then laid over portions fastened to the stool and nailed to the stool preferably at its outer edges.

In accordance with a preferred embodiment the mold shields are positioned and fastened by an operator stationed outside the mold by using specially adapted powder actuated tools. Wall shields are positioned and fastened using a powder actuated tool having an extended handle which drives the nails perpendicular to the tool's longitudinal axis. Stool guards and the angled, flanged portion of the shields are positioned and fastened using a powder actuated tool having an extended handle which drives the nails parallel to the longitudinal axis of the tool.

In a further aspect a process of making steel billets utilizing a mold and stool shielded in accordance with the instant method includes positioning the mold on the stool to provide an open topped billet forming cavity positioning sheet steel shield, which is of a material compatable with the molten metal, having two portions connected by a bend with the bend proximate an intersection of the mold and stool and with the two portions respectively adjacent walls of the mold and stool. The portions are then respectively affixed to adjacent walls by propelling nails through the shield into imbedded relationship with the walls by repetitively actuating a powder actuated tool. A quantity of molten steel is then poured into the cavity at a temperature sufficient to melt the shield and infuse it into a billet formed by subsequent solidification of the molten steel; and at a rate sufficient to substantially immerse the shield before it is melted such that the shield protects the walls of the mold and stool from erroding contact with the pouring stream. The pouring is continued until the cavity is substantially filled and the molten steel allowed to solidify into a billet in the cavity. The billet thereafter is removed from the mold.

It is an object of the instant invention to provide a mold system and a process for securing shields to the mold surface.

BEST MODE FOR CARRYING OUT THE INVENTION

Figure 1:
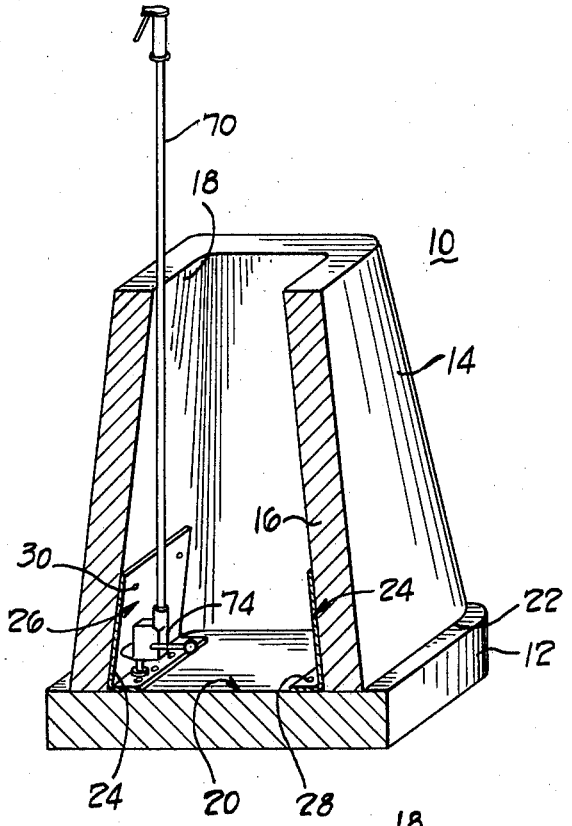
FIG. 1 is a vertical section through an ingot mold employing mold shields in accordance with the instant invention.

Referring now to the drawings, and FIG. 1 in particular, a reference numeral 10 designates an ingot mold assembly for casting of molten steel. The mold assembly 10 includes a cast iron stool 12 which supports a cast iron ingot mold 14. The ingot mold 14 has heavy side walls 16 and interior wall surfaces 18. The mold 14, which is from about 6 to 10 feet high, has an open top through which molten steel is poured and is of a generally rectangular shape having a decreasing cross-section from bottom to top to facilitate removal of the mold from the solidified metal ingots. The mold 14 has an open bottom portion and a bottom rim which seats flush on an upper stool surface 20 of the mold stool 12. The bottom rim of mold 14 and the upper stool surface 20 form a joint 22. The ingot molt 14 is positioned on the stool 12 to form an open topped billet forming cavity.

A joint shield 24 has an upstanding portion 26 which is contoured such that it fits substantially flush against the interior wall surface 18 of the mold 14; and, an angled, outstanding, flanged portion 28 adapted to lie substantially flush against the upper stool surface 20. The portions 26 and 28 are connected by a bend. Once the shield 24 is positioned as shown in FIG. 1, nails 30 are propelled through the upstanding portions 26 of the mold shield 24 and into the interior surface 18 of the mold 14 by an explosive nailing process utilizing a powder actuated tool 32. Likewise, nails 30 are propelled through the angled outstanding, flanged portion 28 of the mold shield 24 into the upper stool surface 20 of the mold stool 12 by the explosive nailing process. As seen in FIG. 1 the powder actuated tool 32 has an elongated handle such that the tool 32 may be actuated from a location remote from the interior of the mold as further described herein.

The powder actuated tool which can be used in accordance with the instant explosive nailing process can be any type known in the art. Preferably the explosive nailing process is accomplished by a powder actuated tool using a piston principle wherein the piston transmits the driving power released by a fired cartridge to a nail positioned in a nail holder. In this manner, the piston, propelled forward by the explosion of the cartridge, drives the nail at a relatively low velocity.

The sheet metal material which can be used in accordance with the instant invention to form the sheet is of a thickness which will be consumed during casting but which will not be consumed so quickly as to allow scab formation, erosion of stool or the like. One advantage of the instant invention is that the shields are secured to the mold walls such that heat transferred through the shield material is uniform. In this manner, a given thickness of metal shield will be consumed uniformly within the mold.

It will be realized that the exact configuration of the mold and joint seals will depend upon the configuration of the mold.

Figure 2:
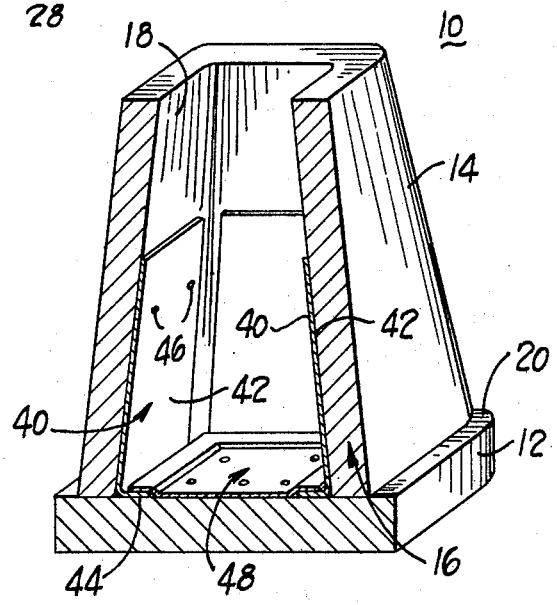
FIG. 2 is a vertical section of an ingot mold employing ¾ splash shields and a stool shield in accordance with the instant invention.

In accordance with another aspect of the invention, a stool shield is utilized in conjunction with the mold shield. Turning to FIG. 2 there is shown a mold shield 40 having an upstanding portion 42 which covers substantially ¾ of the interior wall surface 18 of the mold 14 to provide substantial splash protection. The mold shield 40 has an angled, flanged, outstanding portion 44 connected to the portion 42 by a bend, which is adapted to lie flush on the stool surface 20. The mold shield 40 is fastened by means of nails 46 as previously described. After the insertion of the mold shield 40, a stool shield 48 is positioned flush with the stool surface 20 of stool 12 and overlays the angled, outstanding, flanged portion 44 of mold shield 40. The stool shield 48 is fastened by means of nails 46 in a manner as previously described. Preferably the stool shield 48 is configured to overlap the flanged portion 44 of the shield 40 to provide integrated protection of all of the mold and stool surfaces.

Figure 3:
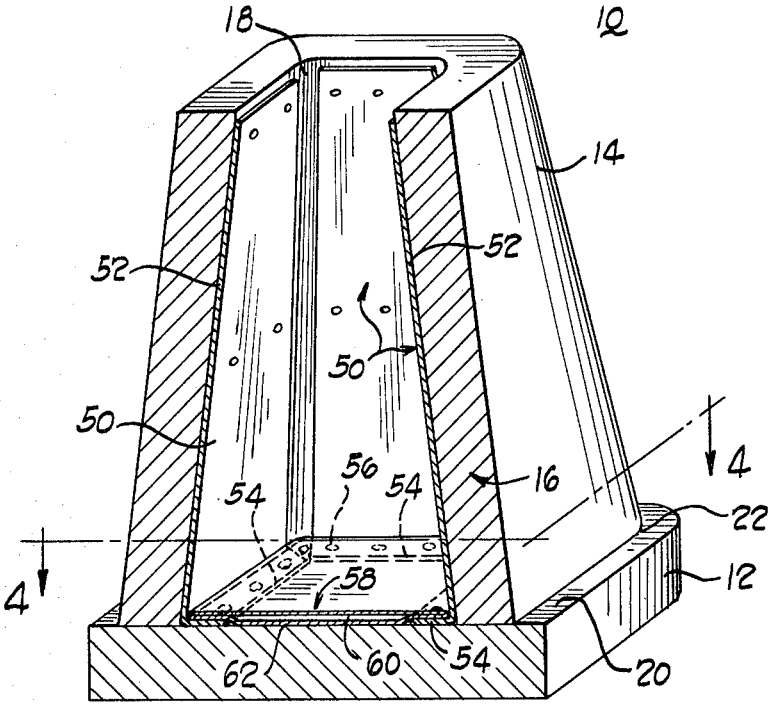
FIG. 3 is a vertical section through an ingot mold employing full wall mold shields and a multilayered stool shield in accordance with another aspect of the instant invention.

A full length mold shield in accordance with the instant invention is shown in FIG. 3 in conjunction with a multi-layered type stool shield. A full length mold shield 52 has an upstanding portion 50 which extends the entire length of the interior surface 18 of the mold 14. A flanged, outstanding, angled portion 54 fits flush against the stool surface 20 to provide a seal at the joint 22.

As depicted in FIG. 3 the upstanding portion 52 of the mold shield 50 does not meet the immediately adjacent mold shield at the corner of the interior mold surface. If desired, the mold shield can have upstanding portions which overlap in the corners; however, this is not deemed necessary for protection of the corner mold surfaces in that the corners are not overly susceptible to erosion and the like.

A stool shield 58 is constructed of two layers of material,—an upper layer 60 and a lower layer 62 —which lie in a more or less parallel configuration to provide a thin envelope or layer of air between adjacent, parallel sheets of material. This layering can easily be accomplished by bending a longer sheet in two before nailing the stool guard in place.

Figure 4:
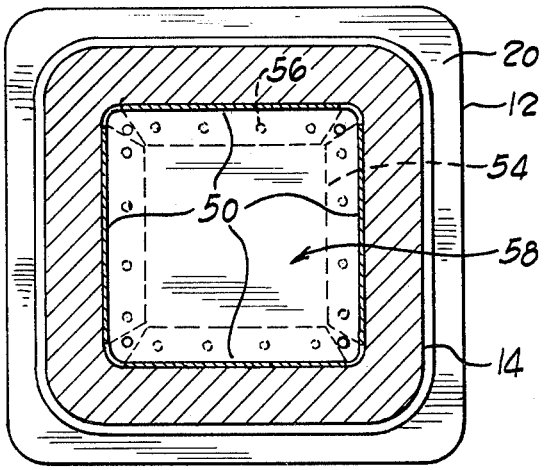
FIG. 4 is a plan view of a cross-section of FIG. 3 taken at 4—4.

As shown in FIG. 4, the layered stool guard is preferably nailed at its corners so that the inherent flexibility of the material tends to keep the sheets separated to provide the layered air therebetween. The stool guard 58 is secured by nails 56 as has been described.

The advantage of the full mold shield and the multi-layer stool guard is the protection of the entire mold surface. The multi-layered stool guard which may comprise more than two layers, cushions the initial molten steel drop such that the molten steel impinging on the uppermost layer does not come into eroding contact with the stool. The uppermost layer aided by the entrapped layer of air maintains integrity to provide a cushion for the remaining poured material. As the upper layer loses integrity becoming infused into the molten material, the lower layer prevents eroding contact of the poured stream with the stool surface 20. As the mold is filled with poured metal the force of the poured stream is cushioned by the poured material to continually diminish the eroding contact on the stool shield.

As seen in FIG. 4, using the full shield configuration protects the entire surface of the interior of the mold save minute gaps at the corners where the upstanding portions interface.

Figure 5:
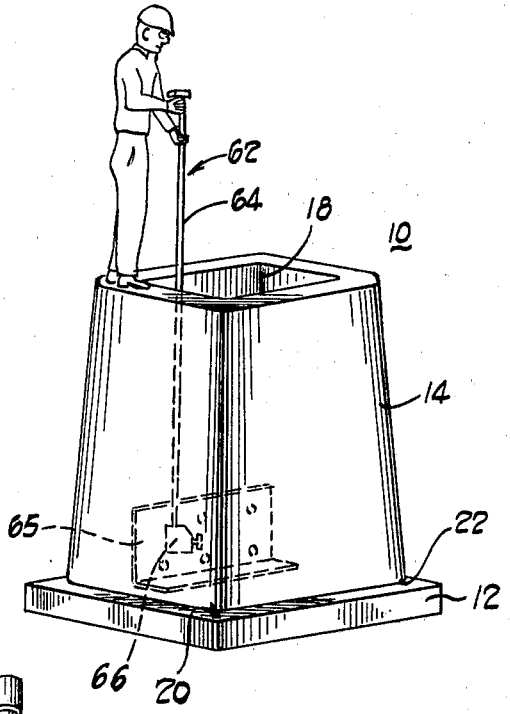
FIG. 5 is the ingot mold of FIG. 3 showing an operator positioned outside the mold using a powder actuated tool having an extended handle for securing wall shields in accordance with the method of the instant invention.

As shown in FIG. 5 the operator stands astride the top of the ingot mold 14 with a powder actuated device 64 which has an elongated handle 62 adapted for actuating the device from this remote position and a nailing head assembly 66 which drives nails substantially perpendicular to the longitudinal axis of the handle. In accordance with this method, a multi-layered shield guard 65 is lowered into the interior of the mold and manipulated into position by means of the head assembly 66 on the extended handle 62 of powder actuated device 64. The multi-layered shield 65 is positioned so that the outstanding flanged angled portion is adjacent the stool with a portion of the outside layer flush with the surface 20; and, the upstanding portion is adjacent the interior wall with another portion of the outside layer flush with the surface 18 of mold 14. When this is accomplished the device 64, having a driving mechanism perpendicular to the longitudinal handle axis, is activated to explosively drive a nail through the upstanding portion of the multi-layered shield 65.

Figure 6:
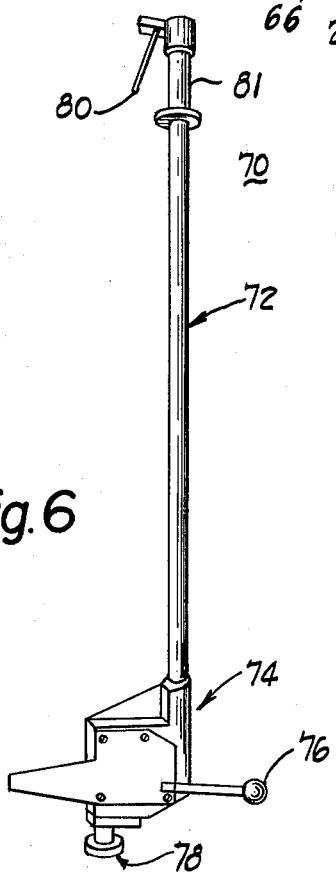
FIG. 6 is a powder actuated tool having an extended handle for securing shields into the stool surface in accordance with the instant invention.

As better seen in FIG. 6, the powder actuated device advantageously used in accordance with the instant invention has an elongated handle. As shown in FIG. 6 a powder actuated device 70 has an elongated handle 72 which can employ for example a telescoping arrangement to vary the length of the handle. A driving head 74, located at the end of handle 72, has a cocking lever 76 for arming the device; and, a nail holder 78 for retaining a nail in position for driving. The head 74 is configured such that the nails held in holder 78 are driven substantially parallel to the longitudinal axis of handle 72. At the end of handle 72 opposite head 74 is a trigger 80 mounted upon a handle grip 81.

In operation the device is loaded with an appropriate powder containing cartridge, a nail placed in the holder 70, and the device cocked by means of a lever 76. The device 70 is then located over the workpiece to be fastened by means of an operator grasping the handle 72 by grip 81. Once the appropriate alignment is attained the device is fired by means of trigger 80.

Figure 7:
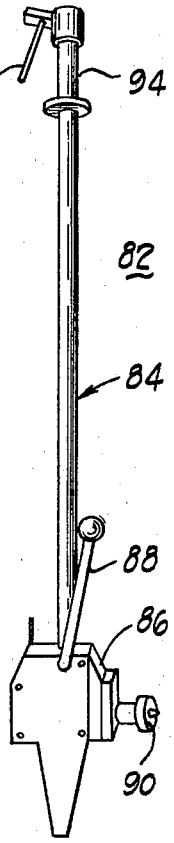
FIG. 7 is a powder actuated tool having an extended handle for securing shields into the mold wall in accordance with the instant invention.

As shown in FIG. 7, a device 82 is substantially identical to device 70 as shown in FIG. 6 having an elongated handle 84, a driving head mechanism 86, a cocking lever 88, a nail holder 90, a trigger 92 and a handle grip 94. The device 82 drives nails situated in holder 90 substantially perpendicular to the longitudinal axis of the elongated handle 84.

Figure 8:
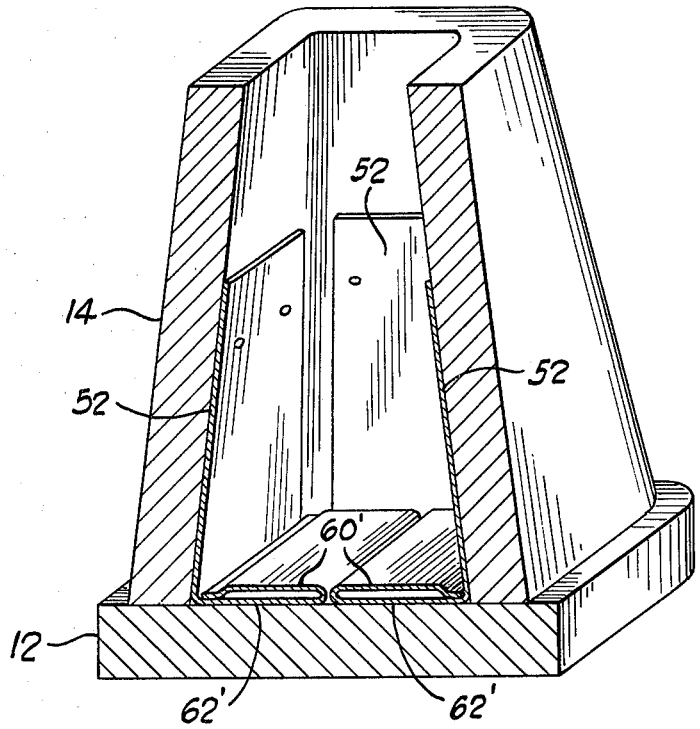
FIG. 8 is a vertical section through an ingot mold employing multi-layered mold wall shields in accordance with another aspect of the invention.

FIG. 8 shows the multi-layered shield 65 schematically depicted in FIG. 5. In that Figure, mold shields 52 are shown as having been bent to provide spaced layers 60', 62'.

Returning now to FIG. 5, the operator using a powder actuated device such as the one illustrated in FIG. 7 positions the mold multi-layered shield 65 and fastens the upstanding portion to the interior wall 18 of the ingot mold 14. In this manner, each of four wall shields is put into position. This first powder actuated device is then extracted and a second device such as the one shown in FIG. 6 is used. This tool propels nails substantially parallel to the longitudinal axis of the handle, to secure the outstanding, angled, flanged portion of the mold shield to the upper stool surface 20 of the stool guard 12. If a stool guard is to be used, the stool guard is lowered into the interior of the mold and similarly positioned and secured by means of the nailing process as previously described.

In this manner a mold can be protected and shielded on the cast house floor with a minimum of effort without the necessity of an operator entering the mold.

While the invention has been explained in relation to its preferred embodiment, it is understood that various modifications thereof will become apparent to those skilled in the art upon reading the specification and it is intended to cover such modifications as fall within the scope of the appended claims.

I claim:

1. A system for prolonging the useful life of a steel ingot mold including a stool and a mold rim which define a cavity in which molten metal is solidified into an ingot comprising:

a mold shield of a metal sheet material, compatible with said molten metal, which is positioned within the interior of the mold cavity such that molten metal poured into the mold splashes and impinges upon the surface of the shield rather than on the walls or floors of the mold cavity, the shield being fastened to interior wall surfaces of the mold by means of nails driven through the mold shield and into the mold by an explosive nailing process, said mold shield having an upstanding portion which substantially covers a vertical interior wall surface of the mold, and said shield also having an angled, outstanding, flanged portion on one end thereof which seats flush against an upper mold stool surface and is adapted for sealing the joint between the mold rim and the stool.

2. A process of making steel ingots with a mold and stool comprising the steps of:

(a) positioning the mold on the stool to provide an open topped ingot forming cavity;

(b) positioning a mold shield of sheet steel having two portions connected by a bend with the bend near an intersection of the mold and stool and with the two portions respectively adjacent walls of the mold and stool;

(c) affixing the portions respectively to the adjacent walls by propelling nails through the shield into imbedded relationship with the walls by repetitively actuating a powder actuated tool;

(d) pouring a quantity of molten steel into the cavity;

(i) at a temperature sufficient to melt the shield and infuse it into an ingot formed by subsequent solidification of the molten steel; and, (ii) at a rate sufficient to substantially immerse the shield before it is melted such that the shield protects the walls of the mold and stool from eroding contact with the pouring stream;

(e) continuing the pouring until the cavity is substantially filled;

(f) allowing the molten steel to solidify into an ingot in the cavity; and, (g) thereafter removing the ingot from the mold.

3. The process of claim 2 further including the step of pouring steel of a type which causes self-agitation in the mold whereby the steel from the metal shield is dispersed through the ingot to provide substantially uniform metallurgical properties.

4. The process of claim 2 wherein the shield is made from steel having metallurgical properties substantially duplicating the properties of the steel of the ingot formed by the process.

5. The process of claim 2 further including the step of positioning a stool shield on the stool and securing it in place with a powder actuated tool.

6. The process of claim 2 further including the step of positioning a stool shield having at least one pair of layers on the stool and securing the stool shield in place while maintaining an air space between each pair of layers.

7. A process of making steel ingots with a mold and stool comprising the steps of:

(a) positioning the mold on the stool to provide an open topped ingot forming cavity;

(b) providing bent sheets of steel to form a mold shield having spaced layers each having two portions connected by a bend;

(c) positioning each shield with the bend near an intersection of the mold and stool and with the portions respectively adjacent walls of the mold and stool and respectively relatively closely spaced from the portions of another layer;

(d) propelling nails through the shield into imbedded relationship with the walls by repetitively actuating a powder actuated tool to fix the portions respectively to adjacent walls;

(e) pouring a quantity of molten steel into the cavity;

(i) at a temperature sufficient to melt the shield and at least portions of the nails to infuse them into an ingot formed by subsequent solidification of the molten steel; but (ii) at a rate sufficient to substantially immerse the shield before both layers are melted whereby the shield protects the walls of the mold and stool from eroding contact with the pouring stream;

(f) continuing the pouring until the cavity is substantially filled;

(g) allowing the molten steel to solidify into an ingot in the cavity; and, (h) thereafter removing the ingot from the mold.

8. A process of making steel ingots with a mold and stool comprising the steps of:

(a) forming an open topped ingot cavity defined by walls of the mold and stool by positioning the mold and stool in registration with one another;

(b) providing a plurality of sheets of steel bent to form mold shields each having a plurality of portions with each pair of portions connected by a bend;

(c) each of the shields being configured to overlie predetermined parts of cavity defining walls of the mold and stool;

(d) positioning each shield with at least one bend respectively near one related intersection of the mold and stool and with certain of the shield portions being adjacent a selected one of the predetermined wall parts;

(e) fixing each of said certain portions to the adjacent one of the predetermined wall parts by powder actuated tool propulsion of nails through the certain shield portions into imbedded relationship with the adjacent wall parts;

(f) pouring a quantity of molten steel into the cavity;

(i) at a temperature sufficient to melt the shields and infuse them into an ingot formed by subsequent solidification of the molten steel; but (ii) at a rate sufficient to substantially immerse the shields before thay are melted whereby the shields protect the walls of the mold and stool from eroding contact with the pouring stream;

(g) continuing the pouring until the cavity is filled to a desired level;

(h) allowing the molten steel to solidify into an ingot in the cavity; and, (i) thereafter removing the ingot from the mold.

9. A mold assembly for casting steel billets comprising:

(a) a stool having surfaces defining a bottom of a billet-forming cavity;

(b) a mold removably mounted on the stool and having walls defining sides of the ingot forming cavity and a top molten steel receiving opening through which molten steel is poured to form an ingot;

(c) a plurality of shields certain of which include a base portion overlying a part of the stool cavity defining surfaces and an upstanding portion positioned adjacent a part of the mold walls;

(d) each of the shields being formed of steel, each of said certain shields having its base and upstanding portions connected by a bend, the shields being of sufficient thickness to protect the mold and stool parts from eroding contact with a pouring stream as an ingot is being formed, but sufficiently thin to be melted by the heat of poured molten steel and to dissolve into the ingot being formed so that the mold and stool can be separated after the ingot formation process is completed;

(e) a plurality of steel nails, each of the steel nails extending through an associated shield and into the body of an associated one of the mold and stool;

(f) each of the nails being in frictional engagement with both one of the stool and mold and the associated one of the shields whereby the nails collectively fix the shields to the mold and stool; and (g) each of the nails being of sufficient size and body to maintain the shield in position relative to the adjacent wall long enough to permit the shield to protect the adjacent wall from eroding contact by the molten stream, but each such nail being of sufficiently small dimension to permit at least the majority of that portion projecting outwardly from the wall to be dissolved into the ingot whereby the mold and stool after ingot formation are of substantially the same shape, configuration and surface smoothness as prior to ingot formation.

10. The assembly of claim 9 further including a stool shield on the stool and secured to the stool.

11. The assembly of claim 9 further including a stool shield having at least one pair of layers, said stool shield being fixed to the stool and having an air space between each pair of layers.

* * * * *